United States Patent [19]

Gibbs

[11] Patent Number: 4,768,296

[45] Date of Patent: Sep. 6, 1988

[54] SHOE PROTECTOR

[76] Inventor: Ronald W. Gibbs, 7254 S. Paxton, Chicago, Ill. 60649

[21] Appl. No.: 111,658

[22] Filed: Oct. 22, 1987

[51] Int. Cl.[4] ..... A43B 13/22

[52] U.S. Cl. ..... 36/72 B; 36/72 R

[58] Field of Search ..... 36/72 R, 72 B, 132, 36/138

[56] References Cited

U.S. PATENT DOCUMENTS

| | | | |
|---|---|---|---|
| 1,770,261 | 7/1930 | Barthes | 36/72 B |
| 1,830,912 | 11/1931 | Ramey | 36/72 B |
| 1,855,304 | 4/1932 | Minton | 36/72 B |
| 2,151,350 | 3/1939 | Glowka | 36/72 B |
| 3,063,172 | 11/1962 | Beattle | 36/72 B |
| 3,983,641 | 10/1976 | Wright | 36/72 B |

FOREIGN PATENT DOCUMENTS

| | | | |
|---|---|---|---|
| 3414908 | 10/1985 | Fed. Rep. of Germany | 36/72 B |
| 2118427 | 11/1983 | United Kingdom | 36/72 B |
| 2142813 | 1/1985 | United Kingdom | 36/72 B |

*Primary Examiner*—Steven N. Meyers

*Attorney, Agent, or Firm*—Hill, Van Santen, Steadman & Simpson

[57] ABSTRACT

The present invention concerns a device for protecting the shoes of a driver of a motor vehicle. The device includes a protective cover which prevents abrasive rubbing action against the heel of a shoe as it rests on a vehicle's floor and which prevents moisture on the floor from reaching the shoe. The cover includes an inner layer made of soft non-abrasive material such as flannel and an outer layer of water impervious material. An applicator comprising two pairs of spring-biased tongs is used to place and secure the cover about a shoe heel.

6 Claims, 1 Drawing Sheet

SHOE PROTECTOR

FIELD OF THE INVENTION

The present invention pertains generally to protective covers for shoes and specifically to a new cover and applicator for same.

BACKGROUND OF THE INVENTION

Virtually all drivers of motor vehicles have experienced the problem of the extra wear of the shoe, boot, etc. located on the foot used to push the accelerator and brake pedals. This extra wear is the result of the constant rubbing of the heel of such foot against the floor and/or center hump of the car. Such rubbing produces worn spots usually located on one side of the heel of the driver's shoe.

This extra wear is caused by the need to keep the accelerator foot at a constant angle, the heel being located on the floor of the car, the toes being located on the accelerator above the floor. Additionally, dirt, rocks and other soiling or abrasive material are deposited on the car floor everytime a driver enters his motor vehicle. Such material contributes to and accelerates the wearing action.

Furthermore, over the years, the price of a pair of shoes has increased greatly. And shoes are sold only in pairs. Thus, a driver may be forced to purchase a pair of shoes, at great cost due to the extra wear of only one shoe.

This wearing of the driver's accelerator foot shoe can be prevented. However, protectors have heretofore been unavailable or inadequate. To be useful, such a protector would need to be small, lightweight, non-abrasive and easily applied.

SUMMARY OF THE INVENTION

The present invention is a shoe protector which is small, lightweight, non-abrasive and easily applied. It comprises both a shoe heel cover and an applicator therefore.

The heel cover comprises an inner layer of a soft non-abrasive material such as flannel cloth or similar material. The cover also includes an outer cover which resists abrasion and which is impervious to water and grit.

The applicator comprises a spring biased tong-like device which applies and secures the heel cover to the heel portions of a driver's shoe. Additionally, the applicator maintains the shape of the cover.

Therefore, an object of the invention is the protection of a driver's shoe from the extra wear caused by the rubbing of the accelerator foot's heel on the floor or center hump of the motor vehicle.

An aspect of the invention is a heel cover comprising an inner layer of non-abrasive material and an outer layer of a plastic or water and grit impervious material.

This object and this aspect and others of the invention will become more apparent below in the description of the preferred embodiment and by reference to the figures.

DESCRIPTION OF THE PREFERRED EMBODIMENTS

Figure 1:
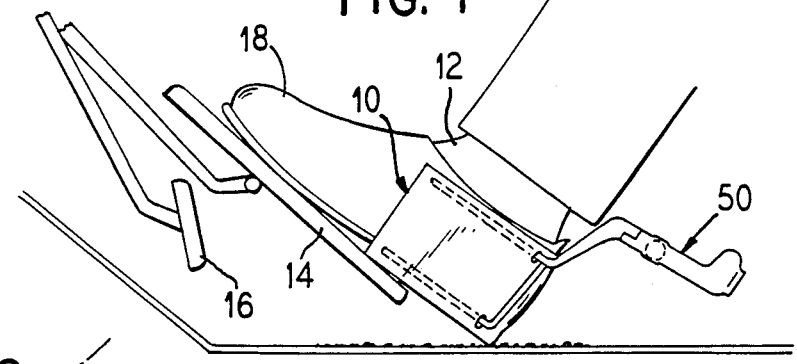
FIG. 1 is a side elevational view of a driver's foot with a protector emboding the principles of the present invention applied and in use.
Figure 2:
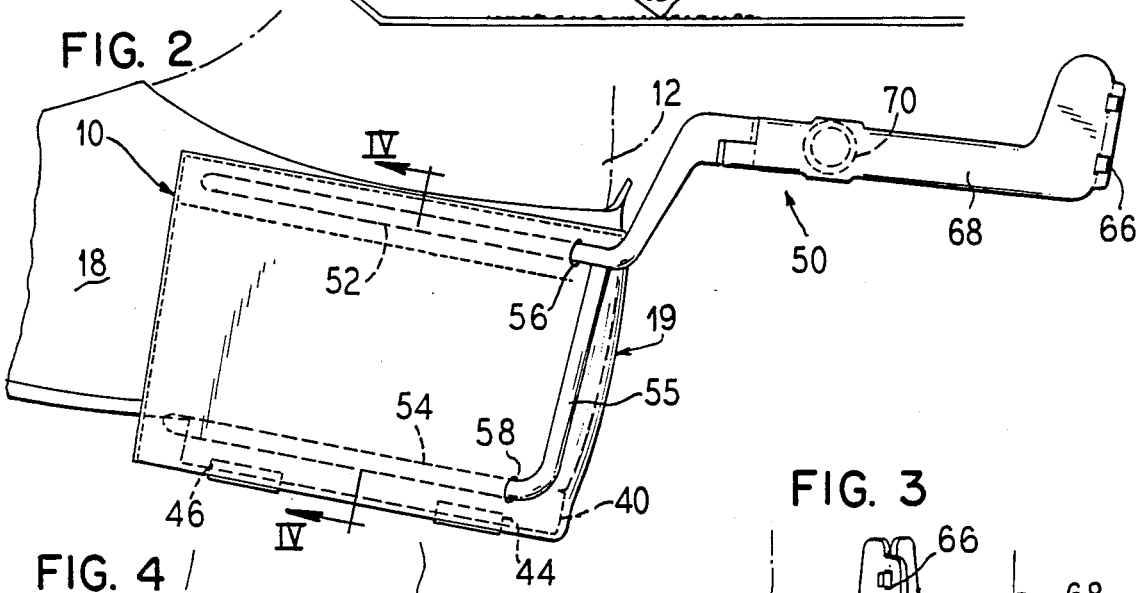
FIG. 2 is an enlarged side elevational view of the protector of FIG. 1 in greater detail.
Figure 3:
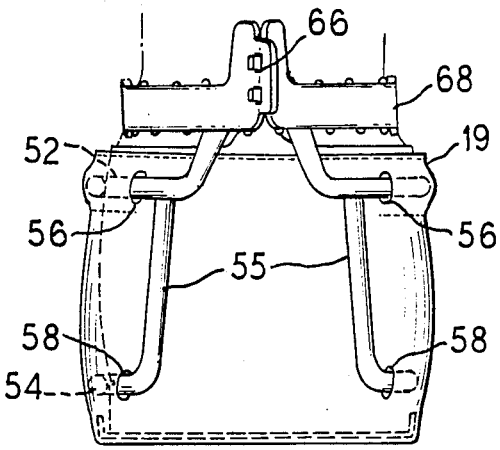
FIG. 3 is an elevational view of the protector of FIGS. 1 and 2 showing the heel end of the protector.

A protector 10 according to the principles of the present invention is shown in use in FIG. 1. A driver of a motor vehicle uses one foot 12 to push an accelerator pedal 14, and, usually, a brake pedal 16. As can be seen in the Figure, the foot by necessity must be held at an angle with its heel on the floor of the motor vehicle and its toe portion on one of the pedals. As a result, a shoe 18 (or any other foot apparel) would be subject to constant wear on its heel were it not for the use of the protector 10.

With reference to FIGS. 2–5, the protector will now be described.

The protector 10 comprises a heel cover 19 having a dual layered construction wherein an outer layer 20 comprises a water resistant material and an inner layer 22 comprises a non-abrasive material. The outer layer keeps moisture and abrasive material located in the floor of the vehicle from reaching the shoe 18 and may be made of plastic or like material. The inner layer 22 provides a soft non-abrasive surface for contact with the shoe 18 and may be made of a soft cloth such as flannel or like material.

Figure 4:
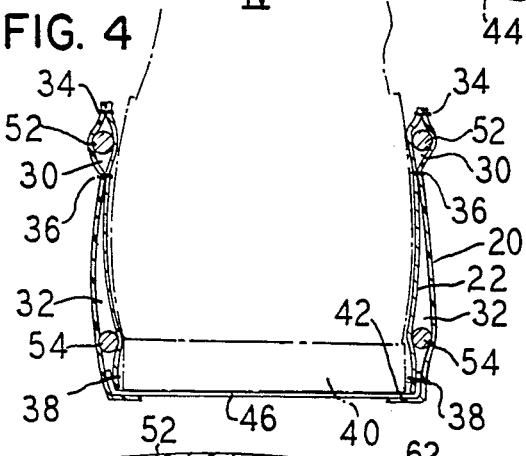
FIG. 4 is a sectional view of the protector taken generally along the line IV—IV of FIG. 2.
Figure 5:
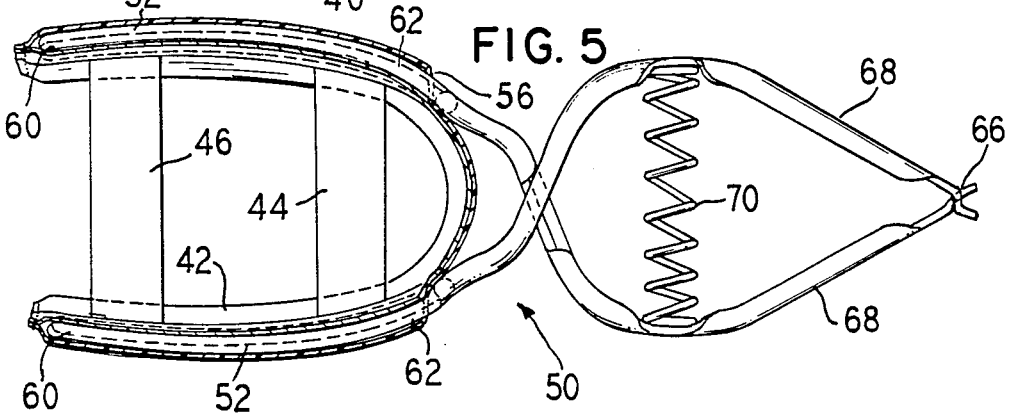
FIG. 5 is a top view of the protector of FIG. 1.

With specific reference to FIG. 4, it is shown that the two layers 20 and 22 are joined together, preferrably by stitching so as to form two sleeves: an upper sleeve 30 and a lower sleeve 32. The cover layers are joined at 34 and 36 to form the smaller diameter sleeve 30 while the space between the layers from 36 to stitch 38 forms sleeve 32.

Of course, it will be apparent to one skilled in the art that a single sleeve construction may also be used wherein the inner layer 22 and outer layer 20 are joined only at 34 and 38. A dual sleeve construction is preferred because of the tighter fit of the tongs within the sleeves.

In FIG. 4, it is also shown that layer 20 extends beneath the heel 40 of the shoe 18 at 42. This extension of the layer 20 provides a seal which helps prevent dirt and water from reaching the shoe from underneath the heel.

Elastic bands 44 and 46 complete the construction of the heel cover 19. These bands are attached across the bottom side of the cover 19 and are in a stretched state whenever the cover is applied. Thus, the bands serve to pull the bottom of the cover snugly to the underside of the shoe and to secure it thereto.

Also shown in the Figures is applicator 50. The applicator comprises two pairs of tongs with upper tongs 52 and lower tongs 54. These tongs are rectilinear at their end portions 60 and curved at their rear portions 62 to conform to the shape of a shoe heel portion. The tongs 52 and 54 are inserted through heel cover holes 56 and 58 respectively, and are received in the sleeves 30 and 32, respectively. Each lower tong 54 is secured to a related upper tong 52 by a vertically extending portion 55 and is provided with a rearwardly extending handle 68. The handles 68 are hinged at 66 by any suitable hinge arrangement and are biased by a spring 70 to close the tongs about the heal of a shoe.

The applicator 50 can be opened by squeezing the spring-biased handles 68 to place the protector on the heel of a shoe. Once the handles 68 are released, the spring 70 bias and elastic bands 44 and 46 secure the cover 19 snugly about the shoe. The tongs of the applicator are strong enough to maintain the heel shape of the heel cover 19 about the shoe. Thus, the heel cover when applied, provides protection from moisture and grit due to the outer layer 20. The shoe is protected from abrasion by inner layer 22. The cover is easily applied and removed by applicator 50.

Although various minor modifications may be suggested by those versed in the art, it should be understood that I wish to embody within the scope of the patent granted hereon all such modifications as reasonably and properly come within the scope of my contribution to the art.

What is claimed is:

1. A device for protecting a shoe comprising:

(a) protective means for preventing abrasive wear of said shoe comprising inner and outer layers joined at top and bottom positions so as to form a sleeve, said inner layer being made of a soft, non-abrasive material, said outer layer being made of a water impervious and wear resistant material, said protective means having a plurality of holes for receiving tongs in said sleeve;

said layers having a width generally equal to the height of a shoe from its sole to its top at its heel; and (b) applicator means for applying said protective means to said shoe comprising two pairs of spring-biased tongs shaped to conform about the shape of a shoe heel, said tongs located in vertical spatial alignment such that an upper pair of tongs are received in an upper portion of said sleeve and a lower pair of tongs are received in a lower portion of said sleeve, whereby, said protective means is applied by inserting said tongs into said sleeve, then separating said tongs slightly to fit about the heel of the shoe, then placing said protective means about said heel and then releasing said tongs and allowing said spring-bias to maintain said tongs and protective cover about the heel of said shoe.

2. A device according to claim 1, wherein said protective means further comprises elastic means for pulling said protective means snugly about the shoe heel.

3. A device according to claim 2, wherein said outer layer of said protective means extends partially underneath said shoe.

4. A device according to claim 3, wherein said spring-biased tongs have a gripping handle with upwardly and rearwardly extending portions including a spring there between for providing such spring-bias.

5. A device according to claim 4, wherein said inner layer is made of a soft cloth.

6. A device for protecting a shoe comprising:

(a) protective means for preventing abrasive wear of said shoe comprising inner and outer layers joined at top, bottom and in-between positions so as to form upper and lower pairs of sleeves, said inner layer being made of a soft, non-abrasive material.

said outer layer being made of a water impervious and wear resistant material, said protective means having a plurality of holes for receiving tongs in said sleeves;

said layers having a width generally equal to the height of a shoe from its sole to its top at its heel; and (b) applicator means for applying said protective means to said shoe comprising two pairs of spring-biased tongs shaped to conform about the shape of a shoe heel, said tongs located in vertical spatial alignment such that an upper pair of tongs are received in said upper pair of sleeves and a lower pair of tongs are received in said lower pair of sleeves, whereby, said protective means is applied by inserting said tongs into said sleeves, then separating said tongs slightly to fit about the heel of the shoe, then placing said protective means about said heel and then releasing said tongs and allowing said spring-bias to maintain said tongs and protective cover about the heel of said shoe.

* * * * *